US006332974B1

(12) United States Patent
Wittenbrink et al.

(10) Patent No.: US 6,332,974 B1
(45) **Date of Patent: *Dec. 25, 2001**

(54) WIDE-CUT SYNTHETIC ISOPARAFFINIC LUBRICATING OILS

(75) Inventors: Robert J. Wittenbrink; Daniel F. Ryan, both of Baton Rouge, LA (US); Paul J. Berlowitz, E. Windsor; Jacob J. Habeeb, Westfield, both of NJ (US)

(73) Assignee: Exxon Research and Engineering Co., Florham Park, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/151,967

(22) Filed: Sep. 11, 1998

(51) Int. Cl.[7] ..... C10G 71/00

(52) U.S. Cl. ..... 208/18; 208/27; 208/86; 208/87; 208/122; 208/121; 208/950; 385/734; 385/739

(58) Field of Search ..... 208/27, 171, 950, 208/86, 87, 18, 121; 585/734, 739

(56) References Cited

U.S. PATENT DOCUMENTS

| | | | | |
|---|---|---|---|---|
| 3,539,498 | | 11/1970 | Morris et al. | 208/111 |
| 4,057,488 | | 11/1977 | Montagna et al. | 208/89 |
| 4,599,162 | | 7/1986 | Yen | 208/59 |
| 4,943,672 | | 7/1990 | Hamner et al. | 585/737 |
| 5,362,378 | * | 11/1994 | Borghard et al. | 208/138 |
| 5,750,819 | | 5/1998 | Wittenbrink et al. | 585/734 |
| 5,756,420 | | 5/1998 | Wittenbrink et al. | 502/313 |
| 5,866,748 | * | 2/1999 | Wittenbrink | 585/734 |
| 5,882,505 | | 3/1999 | Wittenbrink et al. | 208/59 |
| 5,888,376 | * | 3/1999 | Wittenbrink et al. | 208/59 |
| 6,008,164 | | 12/1999 | Aldrich et al. | 508/110 |

FOREIGN PATENT DOCUMENTS

| | | | | |
|---|---|---|---|---|
| 0668342 | | 8/1995 | (EP) | C10G/65/04 |
| 0776959 | | 6/1997 | (EP) | C10G/65/04 |
| WO 97/21788 | * | 7/1997 | (EP) . | |

* cited by examiner

*Primary Examiner*—Helane Myers
(74) *Attorney, Agent, or Firm*—Jay Simon

(57) ABSTRACT

A wide-cut lubricant base stock is made by hydroisomerizing and then catalytically dewaxing a waxy Fischer-Tropsch synthesized hydrocarbon fraction feed and comprises the entire dewaxate having an initial boiling point in the 650–75O° F.+ range. Formulated lubricating oils made by admixing the base stock with a commercial automotive additive package meet all specifications, including low temperature properties, for multigrade internal combustion engine crankcase oils. The waxy feed has an initial boiling point in the 650–750° F. range and continuously boils to an end point of at least 1050° F.+. Lower boiling hydrocarbons produced by the process are separated from the base stock by simple flash distillation. The base stock comprises the entire dewaxate having an initial boiling point in the 650–750° F. range.

22 Claims, 1 Drawing Sheet

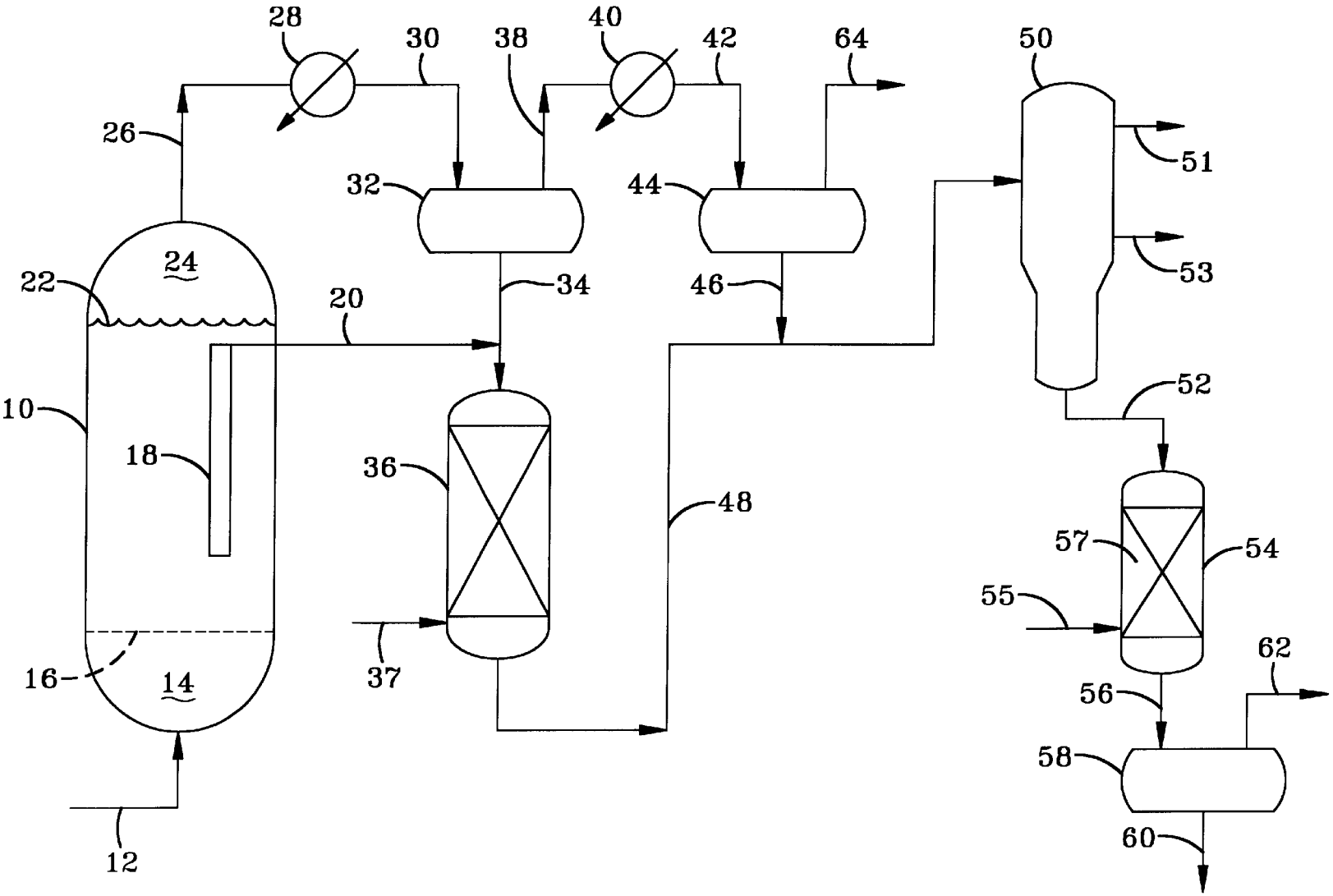
10
12
14
16
18
20
22
24
26
28
30
32
34
36
37
38
40
42
44
46
48
50
51
52
53
54
55
56
57
58
60
62
64

WIDE-CUT SYNTHETIC ISOPARAFFINIC LUBRICATING OILS

BACKGROUND OF THE DISCLOSURE

1. Field of the Invention

The invention relates to a wide-cut, synthetic lubricant base stock synthesized from waxy hydrocarbons produced by a Fischer-Tropsch hydrocarbon synthesis process. More particularly the invention relates to a wide-cut lubricant base stock and formulated lubricating oil having a high VI, low pour point and wide boiling range, produced by hydroisomerizing a waxy Fischer-Tropsch synthesized hydrocarbon fraction, which is then catalytically dewaxed to produce the base stock.

2. Background of the Invention

Internal combustion engine crankcase and transmission oils, as well as some industrial oils, must maintain their lubricating quality over a wide range of temperature without solidifying or volatilizing. The industry is moving toward lighter viscosity grades (e.g., SAE 5W and 10W oils) for fuel economy reasons. However, the oils must also meet volatility specifications. In addition, heavier base stocks, from which fully formulated oils are made, are still utilized in many applications, including industrial oils. With conventional oils, the dewaxed raffinate is typically vacuum fractionated into a plurality of fractions of different viscosities and boiling ranges. The final lubricating oil is made by adding an additive package containing one or more additives such as a VI improver, an antioxidant, a detergent dispersant, antiwear additive, pour point depressant and the like, to the base stock. Lower viscosity base stocks have a higher concentration of lighter and lower boiling hydrocarbons, which tend to volatilize at higher temperatures. Conversely, higher boiling fractions, besides increasing the viscosity, can adversely affect low temperature properties, such as pour point. To use a wide cut derived from a conventional oil, will yield a base stock which will not meet either volatility or pour point requirements. Synthetic base stocks, such as polyalphaolefins (PAO's), are commercially available and have a combination of high viscosity index and low pour point. However, these oils are very expensive, tend to shrink seals and have a narrow boiling range. To be able to use a single, wide-cut oil fraction of lubricating quality as a base stock for a premium lubricating oil, where two or more fractions are now used, would simplify the production, transportation and cost of the oil.

SUMMARY OF THE INVENTION

The invention relates to a wide-cut lubricant base stock having a low pour point and high viscosity index (VI), and to a lubricant formed from the base stock, wherein the base stock is produced from a waxy, paraffinic Fischer-Tropsch synthesized hydrocarbon fraction having an initial boiling point in the range of 650–750° F. (650–750° F.+), by hydroisomerizing the waxy fraction to form a hydroisomerate, which is then catalytically dewaxed to reduce its pour point. Both the hydroisomerization and the catalytic dewaxing convert some of the 650–750° F.+ hydrocarbons into lower boiling hydrocarbons. These light hydrocarbons or lower boiling hydrocarbons, which boil below 650–750° F. (650–750° F.−), are removed from the resulting 650–750° F.+ dewaxate which comprises the base stock. By wide-cut base stock is meant the entire 650–750° F.+ dewaxate. This is in contrast to conventional base stocks, in which the 650–750° F.+ dewaxate is vacuum fractionated into a plurality of fractions of different viscosity and boiling range. By 650–750° F.+ is meant that fraction of the hydrocarbons synthesized by the Fischer-Tropsch process having an initial boiling point in the range of from 650–750° F. and continuously boiling up to an end point of at least, and preferably above, 1050° F. A Fischer-Tropsch synthesized hydrocarbon feed comprising this 650–750° F.+ material, will hereinafter be referred to as a "waxy feed". By waxy is meant containing hydrocarbons which solidify at standard room temperature conditions of temperature and pressure. The waxy feed has negligible amounts of aromatics, sulfur and nitrogen compound impurities. The waxy feed also preferably has a $T_{90}$–$T_{10}$ temperature spread of at least 350° F. The temperature spread refers to the temperature difference in °F., between the 90 wt. % and 10 wt. % boiling points of the waxy feed. The wide-cut base stock is essentially isoparaffinic, in comprising at least 95 wt. % of non-cyclic isoparaffins, has a VI of at least 120, a pour point no higher than −10° C. and is useful as a base stock for various lubricants, including lubricating oils (lube oils), greases and the like. Lube oils comprise an admixture of the base stock and lubricant additives, and include, for example, multi-grade internal combustion engine crankcase oils, automatic transmission oils, industrial oils and the like.

The lower boiling hydrocarbons, known as light ends, are removed from the 650–750° F.+ dewaxate in order for the wide-cut base stock to meet volatility requirements. These light ends may simply be flashed off, to produce the wide-cut base stock. The use of simple flashing to remove the light ends (650–750° F.−) in the process of the invention is significant, in that it eliminates the need for more costly vacuum distillation commonly used with conventional, petroleum oil raffinates. The superior properties of the base stock of the invention, compared to conventional base stocks derived from petroleum oil or slack wax, results from the combination of the relatively pure and essentially paraffinic Fischer-Tropsch waxy feed, and preferably a waxy feed produced by a slurry Fischer-Tropsch process in the presence of a catalyst having a cobalt catalytic component, the hydroisomerization, catalytic dewaxing and removal of the light ends from the dewaxate.

In the practice of the invention, the hydroisomerization is accomplished by reacting the waxy feed with hydrogen in the presence of a suitable hydroisomerization and preferably a dual function hydroisomerization catalyst comprising at least one catalytic metal component to give the catalyst a hydrogenation/dehydrogenation function and an acidic metal oxide component to give the catalyst an acid hydroisomerization function. The hydroisomerization converts a portion of the waxy feed (650–750° F.+) to lower boiling material (650–750° F.−) which, while useful for fuels, is not useful as base stock material. The hydroisomerate may be dewaxed with or without prior removal of the lower boiling material. Dewaxing is accomplished by reacting the hydroisomerate with hydrogen in the presence of a dewaxing catalyst to form a dewaxate, from which the light ends are removed.

BRIEF DESCRIPTION OF THE FIGURE

The FIGURE is a simple schematic flow diagram of the process of the invention.

DETAILED DESCRIPTION

The waxy feed preferably comprises the entire 650–750° F.+ fraction formed by the hydrocarbon synthesis process, with the exact cut point between 650° F. and 750° F. being determined by the practitioner, and the exact end point preferably above 1050° F. determined by the catalyst and process variables used for the synthesis. The waxy feed may also contain lower boiling material (650–750° F.–), if desired. While this lower boiling material is not useful for a lubricant base stock, when processed according to the process of the invention it is useful for fuels. The waxy feed also comprises more than 90 %, typically more than 95 % and preferably more than 98 wt. % paraffinic hydrocarbons, most of which are normal paraffins, and this is what is meant by "paraffinic" in the context of the invention. It has negligible amounts of sulfur and nitrogen compounds (e.g., less than 1 wppm), with less than 2,000 wppm, preferably less than 1,000 wppm and more preferably less than 500 wppm of oxygen, in the form of oxygenates. The aromatics content, if any, is less than 0.5, more preferably less than 0.3 and still more preferably less than 0.1 wt. %. Waxy feeds having these properties and useful in the process of the invention have been made using a slurry Fischer-Tropsch process with a catalyst having a catalytic cobalt component. In the practice of the invention, it is preferred that a slurry Fischer-Tropsch hydrocarbon synthesis process be used for synthesizing the waxy feed and particularly one employing a Fischer-Tropsch catalyst comprising a catalytic cobalt component to provide a high alpha for producing the more desirable higher molecular weight paraffins.

The ($T_{90}$–$T_{10}$) temperature spread of the waxy feed, while preferably being at least 350° F., is more preferably at least 400° F. and still more preferably at least 450° F., and may range between 350° F. to 700° F. or more. Waxy feeds obtained from a slurry Fischer-Tropsch process employing a catalyst comprising a composite of a catalytic cobalt component and a titania have been made meeting the above degrees of paraffinicity, purity and boiling point range, having $T_{10}$ and $T_{90}$ temperature spreads of as much as 490° F. and 600° F., having more than 10 wt. % of 1050° F.+ material and more than 15 wt. % of 1050° F.+ material with respective initial and end boiling points of500° F.–1245° F. and 350° F.–1220° F. Both of these samples continuously boiled over their entire boiling range. The lower boiling point of 350° F. was obtained by adding some of the condensed hydrocarbon overhead vapors from the reactor to the hydrocarbon liquid filtrate removed from the reactor. Both of these waxy feeds were suitable for use in the process of the invention, in that they contained material having an initial boiling point in the range of 650–750° F., which continuously boiled to and end point of above 1050° F., and a $T_{90}$–$T_{10}$ temperature spread of more than 350° F.

Both the waxy feed and the lubricant base stock produced from the waxy feed by the process of the invention contain less heteroatom, oxygenate, naphthenic and aromatic compounds than lubricant base stocks derived from petroleum oil and slack wax. Unlike base stocks derived from petroleum oil and slack wax, which contain appreciable amounts (e.g., at least 10 wt. %) of cyclic hydrocarbons, such as naphthenes and aromatics, the base stocks produced by the process of the invention comprise at least 95 wt. % non-cyclic isoparaffins, with the remainder normal paraffins. The base stocks of the invention differ from PAO base stocks in that the aliphatic, non-ring isoparaffins contain primarily methyl branches, with very little (e.g., less than 1 wt. %) branches having more than five carbon atoms. Thus, the composition of the base stock of the invention is different from one derived from a conventional petroleum oil or slack wax, or a PAO. The base stock of the invention comprises essentially (≧99+wt. %) all saturated, paraffinic and non-cyclic hydrocarbons. Sulfur, nitrogen and metals are present in amounts of less than 1 wppm and are not detectable by x-ray or Antek Nitrogen tests. While very small amounts of saturated and unsaturated ring structures may be present, they are not identifiable in the base stock by presently known analytical methods, because the concentrations are so small. While the base stock of the invention is a mixture of various molecular weight hydrocarbons, the residual normal paraffin content remaining after hydroisomerization and dewaxing will preferably be less than 5 wt. % and more preferably less than 1 wt. %, with at least 50% of the oil molecules containing at least one branch, at least half of which are methyl branches. At least half and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules. PAO oils are a reaction product of alphaolefins, typically 1-decene and also comprise a mixture of molecules. However, in contrast to the molecules of the base stock of the invention, which have a more linear structure comprising a relatively long back bone with short branches, the classic textbook description of a PAO base stock is a star-shaped molecule, and particularly tridecane typically illustrated as three decane molecules attached at a central point. PAO molecules have fewer and longer branches than the hydrocarbon molecules that make up the base stock of the invention. Thus, the molecular make up of a base stock of the invention comprises at least 95 wt. % non-cyclic isoparaffins having a relatively linear molecular structure, with less than half the branches having two or more carbon atoms and less than 25 % of the total number of carbon atoms present in the branches. Because the base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the base stock of the invention, will still provide superior properties in many most cases, although to a lesser degree than only if the base stock of the invention is used. Such additional base stocks may be selected from the group consisting of (i) a hydrocarbonaceous base stock, (ii) a synthetic base stock and mixture thereof. By hydrocarbonaceous is meant a primarily hydrocarbon type base stock derived from a conventional mineral oil, shale oil, tar, coal liquefaction, mineral oil derived slack wax, while a synthetic base stock will include a PAO, polyester types and other synthetics.

As those skilled in the art know, a lubricant base stock is an oil possessing lubricating qualities boiling in the general lubricating oil range and is useful for preparing various lubricants such as lubricating oils and greases. Lubricating or lube oils are prepared by combining the base stock with an effective amount of at least one additive or, more typically, an additive package containing more than one additive, wherein the additive is at least one of a detergent, a dispersant, an antioxidant, an antiwear additive, a pour point depressant, a VI improver, a friction modifier, a demulsifier, an antifoamant, a corrosion inhibitor, and a seal swell control additive. Of these, those additives common to most formulated lubricating oils include a detergent, a dispersant, an antioxidant, an antiwear additive and a VI improver, with the others being optional, depending on the intended use of the oil. An effective amount of one or more additives or an additive package containing one or more such additives is admixed with, added to or blended into the base stock, to meet one or more specifications, such as those relating to a lube oil for an internal combustion engine crankcase, an automatic transmission, a turbine or jet, hydraulic oil, industrial oil, etc., as is known. Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. However, the chemical nature of the various additives is known to those skilled in the art. For example, alkali metal sulfonates and phenates are well known detergents, with PIBSA (polyisobutylene succinic anhydride) and PIBSA-PAM (polyisobutylene succinic anhydride amine) with or without being borated, being well known and used dispersants. VI improvers and pour point depressants include acrylic polymers and copolymers such as polymethacrylates, polyalkylmethacrylates, as well as olefin copolymers, copolymers of vinyl acetate and ethylene, dialkyl fumarate and vinyl acetate, and others which are known. The most widely used antiwear additives are metal dialkyldithiophosphates such as ZDDP in which the metal is zinc, metal carbamates and dithiocarbamates, ashless types which include ethoxylated amine dialkyldithiophosphates and dithiobenzoates. Friction modifiers include glycol esters and ether amines. Benzotriazole is a widely used corrosion inhibitor, while silicones are well known antifoamants. Antioxidants include hindered phenols and hindered aromatic amines such as 2, 6-di-tert-butyl-4-n-butyl phenol and diphenyl amine, with copper compounds such as copper oleates and copper-PIBSA being well known. This is meant to be an illustrative, but nonlimiting list of the various additives used in lube oils. That the performance of a lube oil of the invention differs from that of conventional and PAO oils with the same level of the same additives, demonstrates that the chemistry of the base stock of the invention is different from that of the prior art base stocks.

During hydroisomerization of the waxy feed, conversion of the 650–750° F.+ fraction to material boiling below this range (lower boiling material, 650–750° F.–) will range from about 20–80 wt. %, preferably 30–70 % and more preferably from about 30–60 %, based on a once through pass of the feed through the reaction zone. The waxy feed will typically contain 650–750° F.– material prior to the hydroisomerization and at least a portion of this lower boiling material will also be converted into lower boiling components. Any olefins and oxygenates present in the feed are hydrogenated during the hydroisomerization. The temperature and pressure in the hydroisomerization reactor will typically range from 300–900° F. (149–482° C.) and 300–2500 psig, with preferred ranges of 550–750° F. (288–400° C.) and 300–1200 psig, respectively. Hydrogen treat rates may range from 500 to 5000 SCF/B, with a preferred range of 2000–4000 SCF/B. The hydroisomerization catalyst comprises one or more Group VIII metal catalytic components, and preferably non-noble metal catalytic component(s), and an acidic metal oxide component to give the catalyst both a hydrogenation/dehydrogenation function and an acid hydrocracking function for hydroisomerizing the hydrocarbons. The catalyst may also have one or more Group VIB metal oxide promoters and one or more Group IB metal components as a hydrocracking suppressant. In a preferred embodiment the catalytically active metal comprises cobalt and molybdenum. In a more preferred embodiment the catalyst will also contain a copper component to reduce hydrogenolysis. The acidic oxide component or carrier may include, alumina, silica-alumina, silica-alumina-phosphates, titania, zirconia, vanadia, and other Group II IV, V or VI oxides, as well as various molecular sieves, such as X, Y and Beta sieves. It is preferred that the acidic metal oxide component include silica-alumina and particularly amorphous silica-alumina in which the silica concentration in the bulk support (as opposed to surface silica) is less than about 50 wt. % and preferably less than 35 wt. %. A particularly preferred acidic oxide component comprises amorphous silica-alumina in which the silica content ranges from 10–30 wt. %. Additional components such as silica, clays and other materials as binders may also be used. The surface area of the catalyst is in the range of from about 180–400 $m^2/g$, preferably 230–350 $m^2/g$, with a respective pore volume, bulk density and side crushing strength in the ranges of 0.3 to 1.0 mL/g and preferably 0.35–0.75 mL/g; 0.5–1.0 g/mL, and 0.8–3.5 kg/mm. A particularly preferred hydroisomerization catalyst comprises cobalt, molybdenum and, optionally, copper components, together with an amorphous silica-alumina component containing about 20–30 wt. % silica. The preparation of such catalysts is well known and documented. Illustrative, but non-limiting examples of the preparation and use of catalysts of this type may be found, for example, in U.S. Pat. Nos. 5,370,788 and 5,378,348. The hydroisomerization catalyst is most preferably one that is resistant to deactivation and to changes in its selectivity to isoparaffin formation. It has been found that the selectivity of many otherwise useful hydroisomerization catalysts will be changed and that the catalysts will also deactivate too quickly in the presence of sulfur and nitrogen compounds, and also oxygenates, even at the levels of these materials in the waxy feed. One such example comprises platinum or other noble metal on halogenated alumina, such as fluorided alumina, from which the fluorine is stripped by the presence of oxygenates in the waxy feed. A hydroisomerization catalyst that is particularly preferred in the practice of the invention comprises a composite of both cobalt and molybdenum catalytic components and an amorphous alumina-silica component, and most preferably one in which the cobalt component is deposited on the amorphous silica-alumina and calcined before the molybdenum component is added. This catalyst will contain from 10–20 wt. % $MoO_3$ and 2–5 wt. % CoO on an amorphous alumina-silica support component in which the silica content ranges from 10–30 wt. % and preferably 20–30 wt. % of this support component. This catalyst has been found to have good selectivity retention and resistance to deactivation by oxygenates, sulfur and nitrogen compounds found in the Fischer-Tropsch produced waxy feeds. The preparation of this catalyst is disclosed in U.S. Pat. Nos. 5,756,420 and 5,750,819, the disclosures of which are incorporated herein by reference. It is still further preferred that this catalyst also contain a Group IB metal component for reducing hydrogenolysis. The entire hydroisomerate formed by hydroisomerizing the waxy feed may be dewaxed, or the lower boiling, 650–750° F.– components may be removed by rough flashing or by fractionation prior to the dewaxing, so that only the 650–750° F.+ components are dewaxed. The choice is determined by the practitioner. The lower boiling components may be used for fuels. Employing a rough flash and not fractionating the resulting dewaxate base stock into a plurality of fractions, represents a considerable savings in equipment and energy consumption, which is not possible with a conventional, petroleum derived raffinate.

The practice of the invention is not limited to the use of any particular dewaxing catalyst, but may be practiced with any dewaxing catalyst which will reduce the pour point of the hydroisomerate and preferably those which provide a reasonably large yield of lube oil base stock from the hydroisomerate. These include shape selective molecular sieves which, when combined with at least one catalytic metal component, have been demonstrated as useful for dewaxing petroleum oil fractions and slack wax and include, for example, ferrierite, mordenite, ZSM-5, ZSM-11, ZSM-23, ZSM-35, ZSM-22 also known as theta one or TON, and the silicoaluminophosphates known as SAPO's (5,135,638). The dewaxing may be accomplished with the catalyst in a fixed, fluid or slurry bed. Typical dewaxing conditions include a temperature in the range of from about 400–600° F., a pressure of 500–900 psig, $H_2$ treat rate of 1500–3500 SCF/B for flow-through reactors and LHSV of 0.1–10, preferably 0.2–2.0. The dewaxing is typically conducted to convert no more than 40 wt. % and preferably no more than 30 wt. % of the 650–750° F.+ hydroisomerate to lower boiling material. A dewaxing catalyst comprising a catalytic platinum component and a hydrogen form of mordenite component (Pt/H-mordenite) is preferred.

It has been found that not all dewaxing catalysts and conditions are equivalent when used to dewax the very pure and highly paraffinic hydroisomerate produced by the invention, due to cracking which produces $C_3$–$C_4$ gas and light naphtha For example, U.S. Pat. No. 3,539,498 discloses that by using 0.5 wt. % platinum on H-mordenite for dewaxing a light lube oil distillate feed (600–700° F.) down to a pour point of −10° F., the product yield was only 68 volume %. U.S. Pat. No. 4,057,488 discloses a 65.5 volume % yield from using platinum on H-mordenite to dewax a de-nitrogenated raffinate boiling between 740–950° F. It has been surprisingly and unexpectedly found that by using Pt/H-mordenite to dewax a hydroisomerized Fischer-Tropsch waxy feed boiling in the lube oil range, these high conversion levels and low yields do not occur, and the resulting wide-cut base stock has a lower pour point and higher VI than expected. The base stock comprises at least 99 wt. % of a mixture of paraffins and isoparaffins, boils continuously over its boiling range, from its initial boiling point in the range of 650–750° F., through to its end boiling point of at least 1050° F., with at least 95 wt. % being non-cyclic isoparaffins. The initial boiling point is preferably at least 700° F., and still more preferably at least 750° F., with at least 5 wt. % boiling above 1050° F. The VI of the base stock is at least 120, preferably at least 130 and more preferably at least 140. The pour point of the base stock is no higher than −10° C. and preferably less than −15° C.

Referring to the FIGURE, a slurry hydrocarbon synthesis reactor 10 is shown as comprising a cylindrical vessel with a gas line 12 through which a synthesis gas comprising a mixture of $H_2$ and CO is introduced into a plenum space 14 at the bottom of the vessel and then injected up through a gas injection means briefly illustrated by dashed line 16 and into a slurry (not shown) comprising bubbles of the uprising synthesis gas and solid particles of a Fischer-Tropsch catalyst in a hydrocarbon slurry liquid, which comprises synthesized hydrocarbons which are liquid at the temperature and pressure in the reactor. Suitable gas injection means comprises an otherwise gas and liquid impermeable, horizontal tray or plate containing a plurality of gas injectors horizontally arrayed across and extending through the tray. The $H_2$ and CO in the slurry react in the presence of the particulate catalyst to form predominantly paraffinic hydrocarbons, most of which are liquid at the reaction conditions, particularly when the catalyst includes a catalytic cobalt component. A filter means immersed in the slurry, which is simply indicated by box 18, separates the hydrocarbon liquids in the reactor from the catalyst particles and passes the hydrocarbon liquids out of the reactor via line 20. Unreacted synthesis gas and gas products of the hydrocarbon synthesis reaction pass up and out the top 22 of the slurry and into a gas collection space 24 over the slurry, from where they are removed from the hydrocarbon synthesis reactor as tail gas via line 26. The tail gas is then passed through a first heat exchanger 28, which cools the hot gas from the hydrocarbon synthesis reactor to condense some of the hydrocarbon synthesis reaction water and the heavier hydrocarbon vapors (e.g., ~500–700° F. boiling range) to liquid, with the cooled gas and liquid mixture then passed via line 30 into a hot separation vessel 32, which may be a simple knock-out drum. The condensed hydrocarbon liquids are removed via line 34 and passed into the hydroisomerization reactor 36, along with the hydrocarbon liquids removed from the hydrocarbon synthesis reactor from line 20. The hydrocarbon liquids removed from the hydrocarbon synthesis reactor via line 20 comprise mostly 650–750° F.+ boiling paraffinic hydrocarbons. The water is removed from the separator (not shown), and the water and hydrocarbon-reduced gas is removed via line 38 and passed through a second heat exchanger 40 which cools it down further (e.g., 50–150° F.), to condense out more water and lighter $C_{5+}$ (e.g., $C_{5+}$ up to about 500° F. boiling range) hydrocarbon vapors as liquid, with the gas and liquid mixture passed into a cold separator 44, via line 42, to separate the gas from the water and hydrocarbon liquid layers. The gas is removed from the separator via line 64 and the hydrocarbon liquids via line 46. In the hydroisomerization reactor 36, the mixture of heavy 700° F.+ boiling hydrocarbon liquids removed from the hydrocarbon synthesis reactor and those recovered from the hot separator, react with hydrogen passed into the reactor via line 37, in the presence of a hydroisomerization catalyst, to hydroisomerize the paraffins to branched or isoparaffins as hydroisomerate. The hydroisomerate is removed from reactor 36 and passed, via line 48, into a fractionator 50, in which the lighter hydrocarbons are separated from the 650–750° F.+ fraction as naphtha and diesel fractions via lives 51 and 53, respectively. The lighter hydrocarbon liquid recovered from cold separator 44 are passed, via line 46 into line 48, where they are mixed with the hydroisomerate entering the fractionator. The 650–750° F.+ hydroisomerate is removed from the fractionator via line 32 and passed into a catalytic dewaxing reactor 54, via line 56, in which it reacts with hydrogen entering the reactor via line 55, in the presence of a dewaxing catalyst to further reduce the pour point of the hydroisomerate and produce the base stock. The dewaxing catalyst is preferably platinum on mordenite. The catalytic dewaxing cracks a portion (e.g., ~20 volume %) of the 650–750° F.+ material to mostly gas and naphtha hydrocarbon fractions and lowers the pour point of the remaining 650–750°F.+ base stock, with the mixture of gas and the liquid 650–750° F.+ base stock leaving the catalytic dewaxer via line 56 and passing into a separator 58, in which the hydrocarbons boiling below the desired initial boiling point of at least 650° F., preferably at least 700° F. and more preferably at least 750° F. are simply flashed off and removed with the gas products of the dewaxing. The separator is a simple drum separator in which the gas products and light fraction are separated from the base stock and removed via line 62. The resulting wide cut base stock is removed from the separator via line 60.

In a Fischer-Tropsch hydrocarbon synthesis process, liquid and gaseous hydrocarbon products are formed by contacting a synthesis gas comprising a mixture of $H_2$ and CO with a Fischer-Tropsch catalyst, in which the $H_2$ and CO react to form hydrocarbons under shifting or non-shifting conditions and preferably under non-shifting conditions in which little or no water gas shift reaction occurs, particularly when the catalytic metal comprises Co, Ru or mixture thereof. Suitable Fischer-Tropsch reaction types of catalyst comprise, for example, one or more Group VIII catalytic metals such as Fe, Ni, Co, Ru and Re. In one embodiment the catalyst comprises catalytically effective amounts of Co and one or more of Re, Ru, Fe, Ni, Th, Zr, Hf, U, Mg and La on a suitable inorganic support material preferably one which comprises one or more refractory metal oxides. Preferred supports for Co containing catalysts comprise titania, particularly when employing a slurry HCS process in which higher molecular weight, primarily paraffinic liquid hydrocarbon products are desired. Useful catalysts and their preparation are known and illustrative, but nonlimiting examples may be found, for example, in U.S. Pat Nos. 4,568,663; 4,663,305; 4,542,122; 4,621,072 and 5,545,674. Fixed bed, fluid bed and slurry hydrocarbon synthesis processes are well known and documented in the literature. In all of these processes the synthesis gas is reacted in the presence of a suitable Fischer-Tropsch type of hydrocarbon synthesis catalyst, at reaction conditions effective to form hydrocarbons. Some of these hydrocarbons will be liquid, some solid (e.g., wax) and some gas at standard room temperature conditions of temperature and pressure of 25° C. and one atmosphere, particularly if a catalyst having a catalytic cobalt component is used. Slurry Fischer-Tropsch hydrocarbon synthesis processes are often preferred because they are able to produce relatively high molecular weight, paraffinic hydrocarbons when using a cobalt catalyst. In a slurry hydrocarbon synthesis process, which is a preferred process in the practice of the invention, a synthesis gas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. The stoichiometric mole ratio for a Fischer-Tropsch reaction is 2.0, but in the practice of the present invention it may be increased to obtain the amount of hydrogen desired from the synthesis gas for other than the hydrocarbon synthesis reaction. In the slurry process, the mole ratio of the $H_2$ to CO is typically about 2.1/1. Slurry hydrocarbon synthesis process conditions vary somewhat depending on the catalyst and desired products. Typical conditions effective to form hydrocarbons comprising mostly $C_{5+}$ paraffins, (e.g., $C_{5+}$–$C_{200}$) and preferably $C_{10+}$ paraffins in a slurry process employing a catalyst comprising a supported cobalt component include, for example, temperatures, pressures and hourly gas space velocities in the range of from about 320–600° F., 80–600 psi and 100–40,000 V/hr/V, expressed as standard volumes of the gaseous CO and $H_2$ mixture (60° F., 1 atm) per hour per volume of catalyst, respectively. The hydrocarbons which are liquid at the reaction conditions and are removed from the reactor (using filtration means and, optionally a hot separator to recover $C_{10+}$ from the HCS gas) in a slurry process) comprise mostly (e.g.,>50 wt. % and typically 60 wt. % or more) hydrocarbons boiling over 650–750° F. The Table below shows the fractional make-up (±10 wt. % for each fraction) of hydrocarbons synthesized in a slurry hydrocarbon synthesis reactor using a catalyst comprising cobalt and rhenium on a titania support.

| Boiling Temperature Ranges, ° F. | Wt. % of Fraction |
|---|---|
| IBP–320 | 13 |
| 320–350 | 23 |
| 500–700 | 19 |
| 700–1050 | 34 |
| 1050+ | 11 |
| Total | 100 |

The invention will be further understood with reference to the Examples below. In all of these examples, the $T_{90}$–$T_{10}$ temperature spread of the waxy feed was greater than 350° F.

EXAMPLES

Example 1

A mixture of $H_2$ and CO having an $H_2$ to CO mole ratio of 2.11–2.16 was reacted in the presence of a Fischer-Tropsch hydrocarbon synthesis catalyst in a slurry reactor to form hydrocarbons. The catalyst contained cobalt and rhenium supported on titania. The reaction was conducted at 425° F. and 290 psig, at a linear feed velocity of from 12–17.5 cm/sec. The kinetic alpha of the synthesized hydrocarbons was greater than 0.9 and the hydrocarbons were flash fractionated into three fractions of $C_5$ to about 500° F., 500–700° F. and a 700° F.+ waxy feed. By way of further illustration, referring to the FIGURE the $C_5$–500° F. fraction corresponds to the cold separator liquid withdrawn via line 46, The 500–700° F. is the hot separator liquid withdrawn via line 34 and the 700° F.+waxy feed is the hot, waxy filtrate withdrawn from the reactor via line 20.

Example 2

The 700° F.+ waxy feed fraction was mildly hydroisomerized by reacting with hydrogen in the presence of a fixed bed of a dual function catalyst consisting of cobalt (CoO, 3.2 wt %) and molybdenum ($MOO_3$, 15.2 wt. %) on a silica-alumina cogel acidic support containing 15.5 wt. % silica. The catalyst had a surface area of 266 $m^2$/g and pore volume ($P.V._{H2O}$) of 0.64 mL/g. The reaction conditions included a temperature of 713° F., a hydrogen pressure of 725 psig, a hydrogen treat rate of 2500 SCF/B, an LHSV of 1.1 v/v/hr and a 700° F.+ conversion target of 50 wt. %. The 700° F.+ conversion is defined as:

700° F.+ conversion =[1−(wt. % 700° F.+fraction in product)/(wt. % 700° F.+in feed)×100

The resulting hydroisomerate was fractionated into lighter fuel fractions and a waxy 700° F.+ fraction whose properties are given in Table 1 below.

TABLE 1

| | 700° F.+ Fraction |
|---|---|
| °API Gravity | 40.3 |
| Boiling Point Distribution by GCD, wt % | ° F. |
| IBP/5 | 667/713 |
| 10/20 | 728/755 |

TABLE 1-continued

| 700° F.+ Fraction | |
|---|---|
| °API Gravity | 40.3 |
| Boiling Point Distribution by GCD, wt % | ° F. |
| 30/40 | 781/809 |
| 50/60 | 842/880 |
| 70/80 | 926/984 |
| 90/FBP | 1070/1281 |

Example 3

In this example, the pour point of the waxy, 700° F.+hydroisomerate produced in Example 2 was catalytically dewaxed by reacting with hydrogen in the presence of a dewaxing catalyst consisting of 0.5 wt. % platinum supported on H-mordenite at a temperature of 550° F., hydrogen pressure of 725 psig, a hydrogen treat rate of 2500 SCF/B and LHSV of 1.1 v/v/hr. The dewaxing was conducted at a 20 volume % conversion of the 700° F.+hydroisomerate feed and the resulting base stock had a boiling range of from about 750° F., to greater than 1050° F. and a pour point of +3° F. However, low temperature performance is better indicated by lubricating oils formulated from the base stocks of the invention using other low temperature tests, such as the Cold Cranking Simulator (CCS) viscosity typically used to assess passenger car motor oils, and the Brookfield viscosity used to assess automatic transmission fluids. Table 2 shows a comparison of fully formulated lubricating oils formulated to be essentially 5 cSt viscosity lubricating oils and all containing the same additive package, the same amount of base stock oil and using for the base stock, (a) the wide-cut base stock of the invention, (b) a PAO synthetic base stock and (c) a conventional, petroleum derived base stock. The additive package was a proprietary package for a conventional, multigrade automotive and diesel engine crankcase lube designed to meet API quality requirements (SH/CD) and also ILSACGFI approval with conventional base stocks. As the data in Table 2 show, despite the very wide boiling range and the presence of the heavy, high boiling paraffins present in the wide-cut lubricating oil base stock of the invention, the low temperature properties of the lubricating oil formulated with the base stock of the invention are superior to those of the conventional lubricating oil. Further, the oil formulated from the base stock of the invention exhibits a higher VI than either of the other two oils and with no volatility debit compared to the conventional oil.

TABLE 2

| | Petroleum Oil | Synthetic (PAO) | Wide-Cut |
|---|---|---|---|
| Base Stock Properties | | | |
| Kinematic Viscosity at 40° C., cSt | 5.08 | 5.77 | 5.23 |
| Kinematic Viscosity at 100° C., cSt | 24.49 | 30.13 | 24.89 |
| Viscosity Index | 106 | 137 | 148 |
| SUS Viscosity | 147 | 155 | 128 |
| Pour Point, ° C. | −15 | <−54 | −14 |
| NOACK Volatility, wt. % | 15.4 | 7 | 14.3 |
| Properties of Formulated Passenger Car motor Oils | | | |
| Brookfield Viscosity at −40° C., cP | Solid | 15570 | 17610 |

TABLE 2-continued

| | Petroleum Oil | Synthetic (PAO) | Wide-Cut |
|---|---|---|---|
| Properties of Formulated Passenger Car Motor Oils | | | |
| CCS Viscosity at −20° C. | 3200 | 790 | 1260 |
| CCS Viscosity at −25° C. | 4400 | 2100 | 2400 |

By way of further comparison with a conventional lube oil fraction derived from petroleum oil, the following Table 3 compares the boiling range of the wide-cut base stock of the invention, which has an SUS viscosity of 128, with a 130N or Neutral (SUS viscosity of 130) conventional lube oil base stock. As Table 3 shows, the boiling range of the conventional 130N is substantially less than the wide-cut lube oil base stock of the invention. Further, the wide-cut base stock had about 10 wt. % boiling over 1050° F., while the conventional 130N had none.

TABLE 3

| GCD Fractionation | | |
|---|---|---|
| | Boiling Point, ° F. | |
| Wt. % Fraction | 130N | Wide-cut |
| IBP | | 700 |
| 5 | 685 | 750 |
| 50 | 790 | 820 |
| 95 | 882 | 1050 |
| FBP | | |

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. An isoparaffinic lubricant base stock obtained by (i) hydroisomerizing a paraffinic, Fischer-Tropsch synthesized, waxy hydrocarbon feed having an initial boiling point in the range of 650–750° F., which continuously boils to an end boiling point of at least 1050° F., to form a hydroisomerate having an initial boiling point in said 650–750° F. range, (ii) catalytically dewaxing said hydroisomerate to reduce its pour point and form a dewaxate comprising said base stock having an initial boiling point in said 650–750° F. range, and which continuously boils up to its end boiling point, which is the end boiling point of said dewaxate, and which contains hydrocarbons boiling below said 650–750° F. range, and (iii) removing said lower boiling hydrocarbons from said dewaxate to form said base stock.

2. A lubricant base stock obtained according to claim 1 wherein said waxy feed comprises at least 95 wt. % normal paraffins.

3. A lubricant base stock obtained according to claim 2 wherein the end boiling point of said waxy feed is above 1050° F.

4. A lubricant base stock obtained according to claim 3 wherein said hydroisomerization comprises reacting said waxy feed with hydrogen in the presence of a hydroisomerization catalyst having a catalytic metal component and an acidic metal oxide component and both a hydroisomerization function and a hydrogenation/dehydrogenation function.

5. A lubricant base stock obtained according to claim 4 wherein said waxy feed has less than 1 wppm of nitrogen compounds, less than 1 wppm of sulfur and less than 1,000 wppm of oxygen in the form of oxygenates.

6. A lubricant base stock obtained according to claim 5 in admixture with one or more of (i) a hydrocarbonaceous base stock and (ii) a synthetic base stock.

7. A lubricant base stock obtained according to claim 2 wherein said lower boiling hydrocarbons are removed from said dewaxate by flash evaporation.

8. A lubricant base stock obtained according to claim 1 wherein said lower boiling hydrocarbons are removed from said dewaxate by flash evaporation.

9. A lubricant base stock obtained according to claim 1 having a VI of at least 120 and a pour point of no greater than −10° C.

10. A lubricant base stock obtained according to claim 9 useful for formulating a fully formulated lubricant selected from the group consisting of (a) a multigrade internal combustion engine crankcase oil, (b) an industrial oil, (c) a turbine oil, (d) a hydraulic oil and (e) a grease.

11. A lubricant base stock obtained according to claim 10 wherein said waxy feed has been synthesized by a slurry Fischer-Tropsch process employing a hydrocarbon synthesis catalyst having a cobalt catalytic component and an alpha of at least 0.9.

12. A wide-cut, isoparaffinic lubricant base stock is obtained by (i) hydroisomerizing a paraffinic, Fischer-Tropsch synthesized, waxy hydrocarbon feed having an initial boiling point in the range of 650–750° F., which continuously boils to an end boiling point of at least 1050° F. and has a $T_{90}$–$T_{10}$ temperature spread of at least 350° F., by reacting said feed with hydrogen in the presence of a hydroisomerization catalyst comprising Group VIII and Group VIB metal catalytic components on a support comprising silica-alumina having a silica content of less than 50 wt. %, to form a hydroisomerate having an initial boiling point in said 650–750° F. range, (ii) catalytically dewaxing said hydroisomerate to reduce its pour point and form a dewaxate comprising a base stock fraction having an initial boiling point in said 650–750° F. range and which continuously boils up to its end boiling point, which is the end boiling point of said dewaxate, said dewaxate also containing hydrocarbons boiling below said 650–750° F. range, and (iii) removing said lower boiling material from said dewaxate to form said base stock which has a VI of at least 120 and a pour point no higher than −10° C.

13. A lubricant base stock obtained according to claim 12 having an end boiling point of at least 1050° F.

14. A lubricant base stock obtained according to claim 13 wherein said hydroisomerization catalyst comprises cobalt and molybdenum metal catalytic components and wherein said silica-alumina component is amorphous.

15. A lubricant base stock obtained according to claim 14 comprising at least 95 wt. % non-cyclic isoparaffins.

16. A lubricant base stock obtained according to claim 15 wherein said dewaxing catalyst comprises Pt and H-mordenite.

17. A lubricant base stock obtained according to claim 16 wherein said hydroisomerization converts from 30–70 wt. % of said 650–750F.+ feed to lower boiling hydrocarbons.

18. A lubricant base stock obtained according to claim 17 useful for formulating a fully formulated lubricant selected from the group consisting of (a) a multigrade internal combustion engine crankcase oil, (b) an industrial oil, (c) a turbine oil, (d) a hydraulic oil and (e) a grease.

19. A lubricant base stock obtained according to claim 18 wherein said feed has a $T_{90}$–$T_{10}$ temperature spread of at least 400° F.

20. A lubricant base stock obtained according to claim 19 wherein said lower boiling hydrocarbons are removed from said dewaxate by flash evaporation.

21. A lubricant base stock obtained according to claim 12 wherein said hydroisomerization catalyst comprises cobalt and molybdenum metal catalytic components and wherein said silica-alumina component is amorphous, wherein said dewaxing catalyst comprises platinum and H-momrdenite, wherein said hydroisomerization converts from 30–70 wt. % of said 650–750° F.+feed to lower boiling hydrocarbons and wherein said waxy feed has been synthesized by a slurry Fischer-Tropsch process employing a hydrocarbon synthesis catalyst having a cobalt catalytic component.

22. A lubricant base stock obtained according to claim 21 wherein said lower boiling hydrocarbons are removed from said dewaxate by flash evaporation.

* * * * *